US008067933B2

(12) United States Patent
Rost et al.

(10) Patent No.: US 8,067,933 B2
(45) Date of Patent: Nov. 29, 2011

(54) DEVICE FOR LOCATING A VEHICLE TIED TO A ROADWAY

(75) Inventors: Jens Rost, Dresden (DE); Robert Schmid, Neunkirchen am Brand (DE)

(73) Assignee: Siemens Aktiengesellschaft, Munich (DE)

( * ) Notice: Subject to any disclaimer, the term of this patent is extended or adjusted under 35 U.S.C. 154(b) by 261 days.

(21) Appl. No.: 12/307,680

(22) PCT Filed: Jul. 6, 2006

(86) PCT No.: PCT/DE2006/001189

§ 371 (c)(1),
(2), (4) Date: Jan. 6, 2009

(87) PCT Pub. No.: WO2008/003272

PCT Pub. Date: Jan. 10, 2008

(65) Prior Publication Data

US 2009/0201012 A1 Aug. 13, 2009

(51) Int. Cl.
*G01B 7/14* (2006.01)
*E01B 35/00* (2006.01)

(52) U.S. Cl. ..... 324/207.11; 324/207.12; 324/207.22; 701/23; 33/1 Q; 180/167; 180/169

(58) Field of Classification Search ..... 324/207.11–207.26; 33/1 Q; 701/23; 180/167–169

See application file for complete search history.

(56) References Cited

U.S. PATENT DOCUMENTS

| | | | | |
|---|---|---|---|---|
| 4,603,640 | A * | 8/1986 | Miller et al. | 104/282 |
| 4,655,421 | A | 4/1987 | Jaeger | |
| 7,835,830 | B2 * | 11/2010 | Ellmann et al. | 701/19 |
| 2008/0115372 | A1 * | 5/2008 | Vogel et al. | 33/1 Q |

FOREIGN PATENT DOCUMENTS

| | | | |
|---|---|---|---|
| DE | 3200811 | A1 | 7/1983 |
| FR | 2673901 | A1 | 9/1992 |
| GB | 1595311 | A | 8/1981 |
| WO | 8403264 | A1 | 8/1984 |
| WO | 2004103792 | A1 | 12/2004 |

* cited by examiner

*Primary Examiner* — Jermele M Hollington
*Assistant Examiner* — Emily Y Chan
(74) *Attorney, Agent, or Firm* — Laurence A. Greenberg; Werner H. Stemer; Ralph E. Locher

(57) ABSTRACT

A cost-effective system provides reliable location information for locating a vehicle tied to a guideway. Reference markers are mounted to the guideway and scanning devices are disposed in the vehicle and generate at least one output signal when they pass a reference marker. The scanning devices are formed from several individual sensors which are extended in the driving direction with an average scanning length equal to or greater than a distance between neighboring reference markers.

8 Claims, 2 Drawing Sheets

DEVICE FOR LOCATING A VEHICLE TIED TO A ROADWAY

BACKGROUND OF THE INVENTION

Field of the Invention

Such a device is already known from the prior art. For example, track-bound vehicles have locating systems for determining the position of the vehicle both for the drive control and for the control technology. A locating system of a rail-guided vehicle comprises, for example, a location transponder, installed in the region of the track, as a reference marker, wherein the location transponder is inductively scanned by scanning means arranged in the train, with the result that the scanning means generate a location-dependent output signal.

Although such a locating system is suitable for operating control technology, it is not suitable for drive control of, for example, a magnetic levitation vehicle since, in order to control the drive, the location information has to be available continuously and in real time.

For this reason, it has already been proposed, for example in conjunction with a magnetic levitation railway, to scan inductively the grooves of a laminated stack of the guideway and to use them as a locating signal alongside reference markers installed in a location-dependent fashion.

BRIEF SUMMARY OF THE INVENTION

The object of the invention is to make available a device of the type mentioned at the beginning which makes available reliable location information and is cost-effective.

The invention achieves this object by virtue of the fact that the scanning means are composed of a plurality of individual sensors and extend in the direction of travel with an average scanning length which is equal to or greater than the distance between reference markers which are arranged in the vicinity of one another.

According to the invention, the scanning means are dimensioned in such a way that they are continuously configured to read the reference markers. The scanning means are equally long as or longer than the distance between two reference markers. Within the scope of the invention, continuous location information is provided even on slow journeys or when the vehicle is stationary. In order to increase the resolution of the scanning means, they are composed of individual sensors, wherein the individual sensors are read out individually or are expediently connected to one another, with the result that the scanning means which are composed of the individual sensors generate a single sum signal. For example a control device which scans the output signal or signals by means of a scanning unit by acquiring scanning values, and digitizes the scanning values by means of analog/digital converters or by acquiring digital output signals, is used for reading out. The digitized output values are then subjected to further evaluation steps such as will be explained in more detail below.

The average scanning length is advantageously a multiple of the distance between reference markers. This development according to the invention simplifies the evaluation of the results subsequent to the reading off of the reference marker values.

The individual sensors are advantageously arranged one behind the other in at least one row of sensors which extends in the direction of travel. The bar-shaped configuration of the scanning means and the orientation of the longitudinal axis of this bar in the direction of travel makes available a particularly cost-effective scanning means since in this way the greatest possible distance between the reference markers is made possible for a given length of the scanning means.

Individual sensors which are arranged one next to the other or one behind the other advantageously generate output signals with different signs when they travel over a reference marker. For example, the individual sensors in the case of inductive scanning have a different direction of winding. However, different sign can also be implemented with different measuring principles. According to the invention, any measuring principles which are suitable for contactless sensing of the reference markers can be used. Inductive measurements, eddy current effects, transformatory, magnetic and electromagnetic coupling are mentioned only by way of example. Therefore, according to this advantageous development of the invention a periodic output signal of the scanning means is generated when a reference marker is traveled over, and in this context location information can be obtained by simply counting the maximum and minimum values of the periodic output signal. The periodic output signal of the scanning means has a wavelength which is twice as long as the dimensioning of the reference marker which has just been traveled over. In this context it is, of course, expedient if all the reference markers are configured and dimensioned in the same way.

According to one development in this respect, the individual sensors are arranged in two rows of sensors which lie one next to the other and extend in the direction of travel, wherein the rows of sensors have an offset with respect to one another in the direction of travel, and the offset is equal to half the dimension of the reference marker in the direction of travel. In this context, the sum signal of each row of sensors is read out individually and fed to a control device or an evaluation device. In this way, two periodic output signals are obtained which are phase-shifted by 90° with respect to one another. In other words, for example a sinusoidal output signal and a cosinusoidal output signal are obtained. It is possible to use this information to calculate, for example by employing the arc tangent 2 function, the angle from which a precise location information of the vehicle can be derived. Furthermore, it is easily possible to determine the direction of travel. Of course, the number of measured reference markers or the number of periods traveled through can also easily be derived. In this way, all the measured values which are necessary to control the drive system are made available in real time. The rows of sensors are arranged, for example, one next to the other in a plane which is oriented parallel to the guideway. However, the rows of sensors can also be arranged one on top of the other with respect to the guideway, but the requirements made of the evaluation electronics are increased.

In the differing configuration of the invention, individual sensors which are arranged one next to the other generate output signals with the same sign when they travel over a reference marker, and an individual sensor signal can be sensed by each individual sensor. According to this advantageous development, the evaluation unit transmits, at different times, a virtually identical output signal which originates, however, from different individual sensors. The evaluation unit has information data. On the basis of the information data it is possible to determine at what time the output signal is picked up and from which individual sensor or sensors the output signal originates. The calculation of the speed is then based on a correlation. The evaluation device attempts to bring the output signals of the individual sensors which are recorded at different times into congruence with one another. This is achieved within the scope of the measuring accuracy of the individual sensors. By virtue of the known distance between the individual sensors which have generated the respective output signal, and on the basis of the time difference between the times of the reading out of the output signals, the evaluation device determines the speed and transmits this speed to, for example, a drive controller which is superordinate to the evaluation device.

According to one advantageous development, the reference markers are electrically conductive ground plates. These are arranged, for example, in the guideway. It is therefore possible for them to be, for example, rail ties. In a departure from this, the ties are laid in the roadway of a magnetic levitation railway. As has already been stated, the contactless scanning of the reference markers by the scanning means can be carried out on the basis of any desired measuring principles. However, within the scope of the invention, the scanning is done in a contactless fashion. According to one preferred embodiment, the individual sensors sense the position of the reference markers on the basis of eddy current effects. In other words, the individual sensors operate on an eddy current basis.

The distance between the reference markers is advantageously greater than one meter. In particular it is advantageous if the distance between the reference markers is two meters. In this way, on the one hand excessively large dimensioning of the scanning means is avoided. On the other hand, the number of reference markers which are laid in the guideway is limited.

Further expedient embodiments and advantages of the invention are the subject matter of the following description of exemplary embodiments of the invention with reference to the figures in the drawing, with identical reference symbols referring to identically acting components, and in which:

DESCRIPTION OF THE INVENTION

Figure 1:
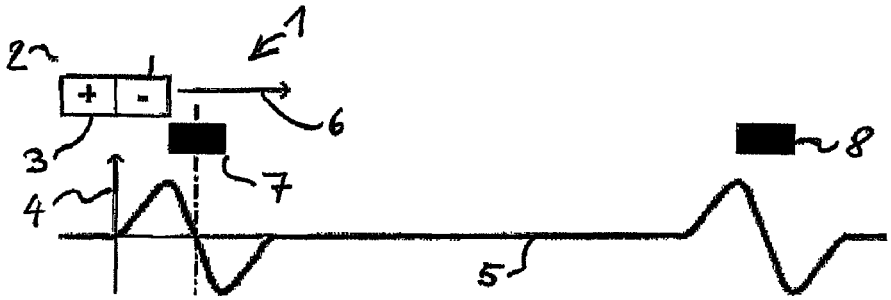
Prior Art FIG. 1
FIG. 1 shows a device for feeding into the invention.

FIG. 1 shows a device 1 which is intended to allow the invention to be understood better. The device 1 which is referred to as the prior art has a scanning means 2 which is composed of two individual sensors 3, wherein the individual sensors 3 generate an output signal with an opposite sign, as is clarified in the illustration below and in which the output signal of the scanning means 2 is represented on the ordinate 4 as a function of the travel which is plotted on the abscissa 5. In this context, the scanning means 2 is moved over a reference marker 7 in the direction of the indicated arrow 6. A corresponding signal is obtained when the following reference marker 8 is traveled over.

Figure 2:
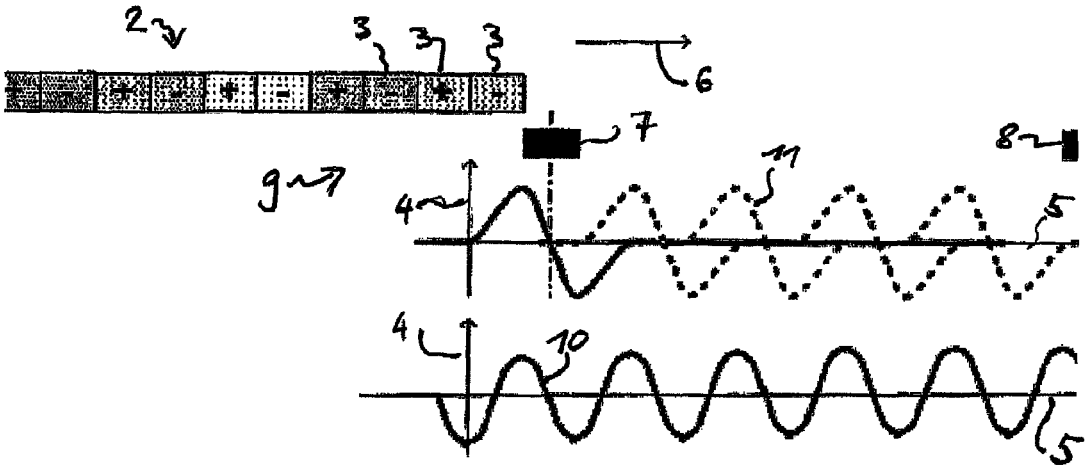
FIG. 2 shows an exemplary embodiment of the invention.

FIG. 2 shows a device 9 according to the invention. The device 9 according to the invention again comprises a sequence of successive reference markers 7 and 8. In contrast to the device 1 according to FIG. 1, the scanning means 2 is composed, however, of a plurality of individual sensors 3 and has a length which is greater than the distance between the reference markers 7 and 8. This ensures that according to the invention the scanning means 2 generates a continuous signal which can be used by a drive controller to control the drive of a track-bound vehicle. The output signal of the scanning means 2 according to FIG. 2 is obtained by virtue of corresponding connection of the individual sensors as a sum signal 10 of the individual signals 11 of each individual sensor 3, wherein the individual sensors 11 are shown next to one another in the top diagram in FIG. 2, and the sum signal 10 is shown in the bottom diagram in FIG. 2. It is apparent that the sum signal 10 has a periodic profile, wherein the wavelength of the sum signal 10 corresponds to twice the length of the respective reference marker 7 or 8 in the direction of travel. The length of the scanning means 2 is equal to the distance between the reference markers 7 and 8, that is to say the reference marker distance, in the exemplary embodiment shown in FIG. 2. In this way, a sum signal 10 is continuously available.

Within the scope of the invention, the scanning means 2 is connected to an evaluation unit which scans the sum signal of the scanning means so as to acquire scanned values, and converts the scanned values by means of an analog/digital converter so as to acquire digital scanned values. By counting the maximum value of the periodic signal in a time interval, the speed of a track-bound vehicle and therefore of the scanning means which is permanently anchored to the track-bound vehicle are acquired.

Figure 3:
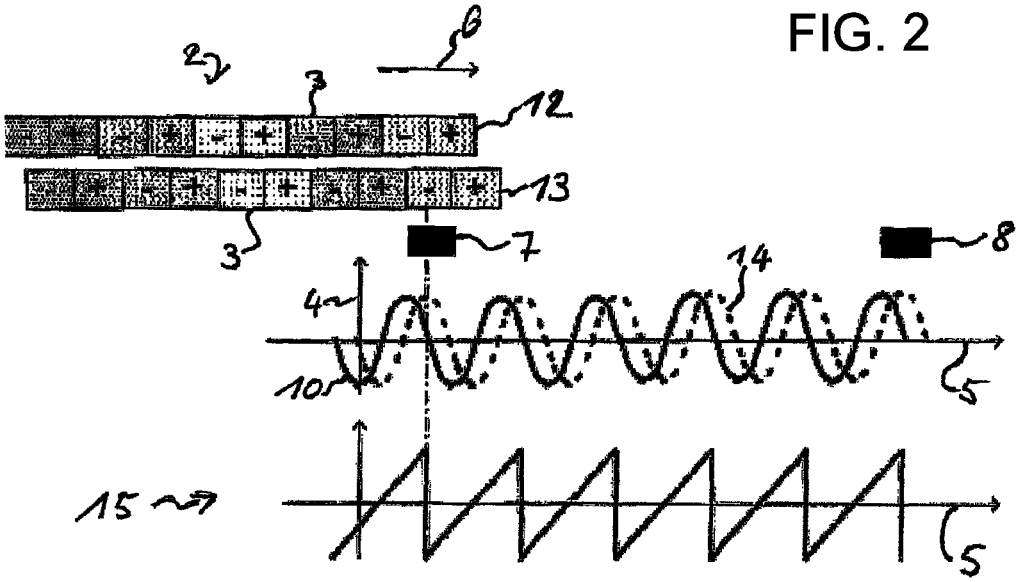
FIG. 3 shows a further exemplary embodiment of the invention.

FIG. 3 shows the most preferred exemplary embodiment of the invention. It is apparent that the scanning means 2 is composed of two rows 12 and 13 of sensors, wherein each row 12 or 13 of sensors extends in the direction of travel, and wherein the individual sensors 2 are arranged one next to the other and in the form of a rod. It is apparent that the row 12 of sensors is offset by a distance, that is to say has an offset, with respect to the row 13 of sensors in the opposite direction to the direction 6 of travel, with the offset being equal to half the length or the geometric dimensioning of the reference marker 7 or 8 in the direction 6 of travel. For this reason, the sum signal 14 of the row 13 of sensors is phase-shifted by 90 degrees with respect to the sum signal 10 of the row 13 of sensors, as is apparent from the illustration 14 in FIG. 3. In the evaluation device which is connected downstream, an evaluation is possible to the effect that the angle $\alpha$ is determined from the measured sine function or cosine function by simple trigonometric conversion, for example by forming the arc tangent 2 or by utilizing the relationship that the square of the sine plus the square of the cosine equals 1. Precise local resolution can be obtained with the angle $\alpha$. In addition, it is possible to use the phase shift to determine the direction in which the track-bound vehicle or the scanning means is moved.

The illustration 15 in FIG. 3 shows an angle signal, which has become customary in drive control, as a function of the time, wherein the gradient of the saw tooth curve corresponds to the speed of the vehicle.

Figure 4:
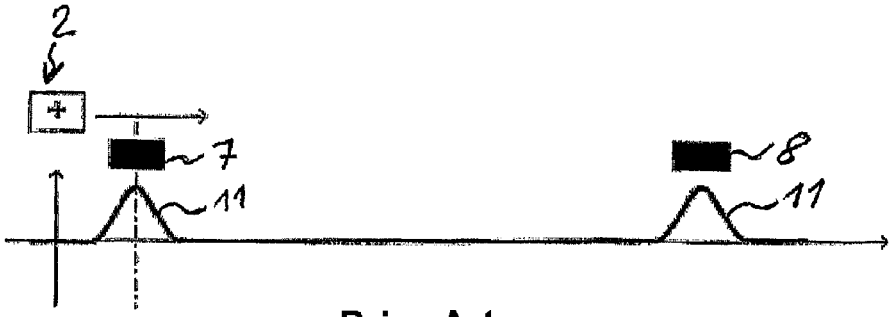
Prior Art FIG. 4
FIG. 4 shows a differing exemplary embodiment according to the prior art.

FIG. 4 shows a further locating system according to the prior art. In contrast to the exemplary embodiments shown above, the scanning means 2 here merely has one individual sensor so that when the reference marker 7 or 8 is traveled over an output signal 11 with a positive sign is generated.

Figure 5:
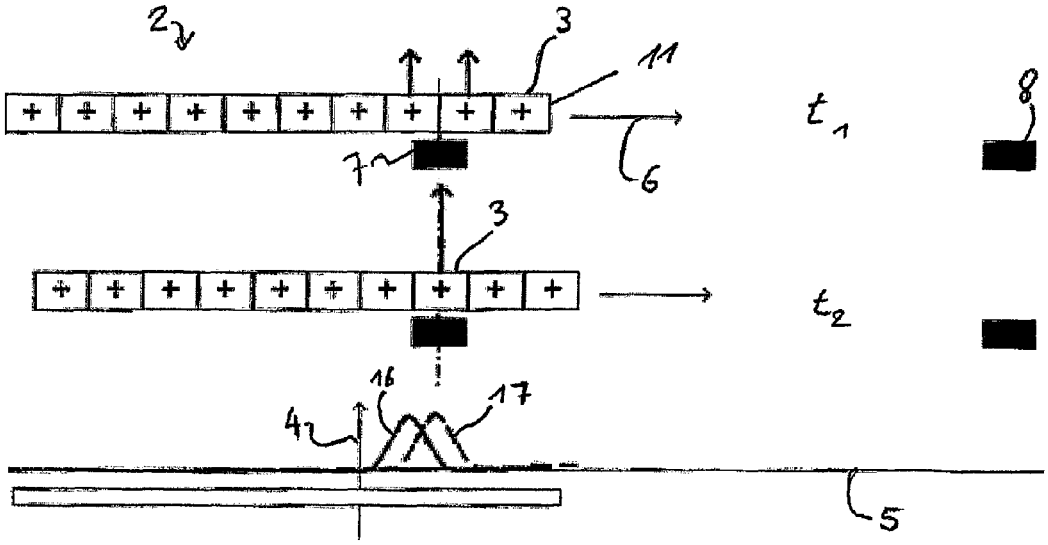
FIG. 5 shows an exemplary embodiment of the invention which differs from the exemplary embodiments according to FIGS. 2 and 3.

FIG. 5 shows a further exemplary embodiment of the device according to the invention, wherein a scanning means 2 interacts with reference markers 7 and 8. In contrast to the exemplary embodiment according to the invention which is shown in FIGS. 2 and 3, the scanning means 2 has a plurality of individual sensors 3 which all generate output signals 16 and 17 with the same sign. In this context, the individual sensors 3 are again arranged one behind the other in the direction of travel, forming a bar-shaped scanning means 2.

FIG. 5 shows the position of the scanning means 2 with respect to the reference markers 7 and 8 at two different times $t_1$ and $t_2$. It is assumed here that the scanning means 2 moves in the direction of the arrow 6. According to the exemplary embodiment shown in FIG. 5, the individual sensors 2 are not connected to form a sum signal. Instead, the output signal of each individual sensor 3 is sensed separately by an evaluation device (not illustrated figuratively in FIG. 5). The output signals are, as has already been stated, scanned and the scanned values obtained converted into digital scanned values by means of an analog/digital converter. The evaluation device subsequently recombines the digital scanned values which are obtained, with the result that at the time $t_1$ an output signal 16 is obtained which is illustrated figuratively in the bottom diagram in FIG. 5. In the diagram, the plotted intensity of the output signal 16 or 17 is illustrated on the ordinate 4 as a function of the location or travel which is plotted on the abscissa 5. The maximum value of the output signal, which would have been measured from the right with the first individual sensor 3, would therefore lie directly on the axis 4.

The output signals 16 and 17 can also be perceived as a scanned image of the reference markers 7 and 8. The evaluation device then uses an internal logic to shift the output signal 6 on the axis 5 until the output signals 16, 17 or the images of the reference markers 7 which are scanned at various times is made to correspond as precisely as possible within the scope of the measuring accuracy of the individual sensors 3. The travel which the scanning means 2 has carried out in the time interval between $t_1$ and $t_2$ can then be derived from the shift in the direction of the axis 5. In this way, it is then possible to derive a speed with which the scanning means, and therefore the vehicle on which the scanning means 2 is mounted, is moving in the direction 6 of travel.

The invention claimed is:

1. A system for locating a vehicle tied to a guideway, comprising:

a plurality of reference markers disposed on the guideway at a given spacing distance along the guideway;

a scanning device mounted to the vehicle and generating an output signal when said scanning device passes a reference marker as the vehicle travels along the guideway;

said scanning device having a plurality of individual sensors and extending in a direction of travel with an average scanning length, the average scanning length being equal to or greater than the given spacing distance between mutually adjacent said reference markers;

said individual sensors disposed next to one another being configured to generate output signals with mutually different signs as said individual sensors travel over a reference marker;

said individual sensors being disposed in two rows of sensors next to one another and extend in the direction of travel;

said two rows of sensors being disposed with an offset relative to one another in the direction of travel;

said offset being equal to half a dimension of said reference markers in the direction of travel; and said scanning device being configured to continuously read said plurality of reference markers located along the guideway.

2. The device according to claim 1, wherein the average scanning length is a multiple of the given spacing distance between said reference markers.

3. The device according to claim 1, wherein said individual sensors are disposed one behind another in at least one row of sensors extending in the direction of travel.

4. The device according to claim 1, wherein said individual sensors of each row of sensors are connected to one another in such a way that a sum signal of the scanning means can be sensed.

5. The device according to claim 1, wherein said individual sensors that are arranged next to one another generate output signals with the same sign when they travel over a reference marker, and an individual sensor signal can be sensed by each individual sensor.

6. The device according to claim 1, wherein said reference markers are electrically conductive ties.

7. The device according to claim 1, wherein said individual sensors are configured to operate on an eddy current basis.

8. The device according to claim 1, wherein said given spacing distance between said reference markers is greater than 1 m.

* * * * *